United States Patent [19]

Faulkner

[11] Patent Number: 4,588,922

[45] Date of Patent: May 13, 1986

[54] ELECTRON DISCHARGE DEVICE HAVING A THERMIONIC ELECTRON CONTROL PLATE

[75] Inventor: Richard D. Faulkner, Manheim Township, Lancaster County, Pa.

[73] Assignee: RCA Corporation, Princeton, N.J.

[21] Appl. No.: 590,792

[22] Filed: Mar. 19, 1984

[51] Int. Cl.[4] ..... H01J 40/04; H01J 43/06

[52] U.S. Cl. ..... 313/533; 313/536; 313/537

[58] Field of Search ..... 313/533, 535, 536, 537; 250/207

[56] References Cited

U.S. PATENT DOCUMENTS

| | | | |
|---|---|---|---|
| 2,231,698 | 2/1941 | Zworykin et al. | 313/536 |
| 2,396,023 | 3/1946 | Schantz . | |
| 2,796,547 | 6/1957 | Nevin . | |
| 2,868,994 | 1/1959 | Anderson | 250/207 |
| 2,895,068 | 7/1959 | Rodda | 313/537 |
| 2,952,499 | 9/1960 | Carson . | |
| 3,409,778 | 11/1968 | Eberhardt | 250/207 |
| 4,079,282 | 3/1978 | Faulkner et al. . | |
| 4,376,246 | 3/1983 | Butterwick | 250/207 |

*Primary Examiner*—Palmer C. DeMeo

*Attorney, Agent, or Firm*—Eugene M. Whitacre; Dennis H. Irlbeck; Vincent J. Coughlin, Jr.

[57] ABSTRACT

An improved electron discharge device comprises an evacuated envelope having therein a photoemissive cathode for providing photoelectrons in response to radiation incident thereon, an electron multiplier, including a primary dynode spaced from the cathode, and a focusing assembly disposed between the cathode and the multiplier. A thermionic electron control plate is disposed between the focusing assembly and the multiplier to prevent thermionic electrons from the focusing assembly from impinging on the primary dynode, while permitting the passage of photoelectrons to the primary dynode. The control plate overlies the primary dynode and is contiguous therewith.

5 Claims, 4 Drawing Figures

ELECTRON DISCHARGE DEVICE HAVING A THERMIONIC ELECTRON CONTROL PLATE

The invention relates to an electron discharge device and, more particularly, to a photomultiplier tube having a thermionic electron control plate for preventing thermionic electrons emanating from a focus means from impinging on a primary dynode of an electron multiplier.

U.S. patent application Ser. No. 546,478, filed on Oct. 28, 1983, by R. D. Faulkner et al. entitled, "ELECTRON DISCHARGE DEVICE HAVING A THERMIONIC EMISSION-REDUCTION COATING", discloses an indium or indium oxide coating which is deposited on the sidewall of a photomultiplier tube envelope. The coating alloys with the constituents of the photoemissive cathode, deposited on the sidewall of the envelope, to reduce thermionic emission contributed by thermionic electrons emanating from the portion of the cathode formed on the sidewall. The Faulkner et al. patent application, which is assigned to the assignee of the present invention, is incorporated herein for the purpose of disclosure. As disclosed in the copending Faulkner et al. patent application, thermionic electron emission generally originates from the photoemissive cathode or from other surfaces in the tube on which low work function alkali materials have been deposited. The tube described in the copending Faulkner et al. patent application is designated the RCA C31016G and is a glass envelope tube used for oil-well logging. Logging is a term given to the method of determining the mineral composition and structure of the geological media along bore holes. Photomultiplier tubes used in oil-well logging are subjected to shock, vibration and high operating temperatures. In fact, since bore holes are typically thousands of meters deep and may exceed about ten-thousand meters, the temperature in the bore hole may range between about 100° C. and 250° C. As the temperature increases, the thermionic electron emission also increases, thus, reducing the signal-to-noise ratio of the tube. It is desirable to eliminate or reduce all possible sources of thermionic electron emission within the tube.

U.S. Pat. No. 4,376,246, issued to G. N. Butterwick on Mar. 8, 1983, which is incorporated herein for the purpose of disclosure, describes an oil-well logging tube, designated the RCA C83027, which is similar to the above-described C31016G, except that it is more rugged and has a ceramic-metal tube envelope, a sapphire faceplate, a brazed ceramic-metal stem and an improved focusing electrode assembly. The focusing electrode assembly in the C83027 has been found to be a source of thermionic electron emission at high operating temperatures. Unlike the C31016G in which the focusing electrode assembly comprises a single cup-shaped member which is maintained at primary dynode potential (i.e., a potential positive with respect to the photoemissive cathode), the focusing electrode assembly of the C83027 is a multicomponent structure comprising a primary focusing electrode subassembly and a secondary focusing electrode. The improved focusing assembly permits two different voltages to be applied to the two electrically insulated focusing elements. The secondary focusing electrode, comprising the cup-shaped member of the focusing electrode assembly, operates at cathode potential, thus, placing a potential thermionic electron emission source in proximity to the electron multiplier. Tests have shown that at operating temperatures above 175° C., the noise generated by thermionic electrons, emanating from the lower surface of the second focusing electrode of the focusing electrode assembly and impinging on the primary dynode of the electron multiplier, is of such a magnitude as to reduce the signal-to-noise ratio of the tube to an unacceptable level.

SUMMARY OF THE INVENTION

An improved electron discharge device comprises an evacuated envelope having therein a photoemissive cathode for providing photoelectrons in response to radiation incident thereon, electron multiplier means, including a primary dynode spaced from the cathode, and focus means disposed between the cathode and the multiplier means. A thermionic electron control plate is disposed between the focus means and the multiplier means to prevent thermionic electrons from the focus means from impinging on the primary dynode, while permitting the passage of photoelectrons to the primary dynode. The control plate overlies the primary dynode and is contiguous therewith.

DETAILED DESCRIPTION OF THE PREFERRED EMBODIMENTS

Figure 1:
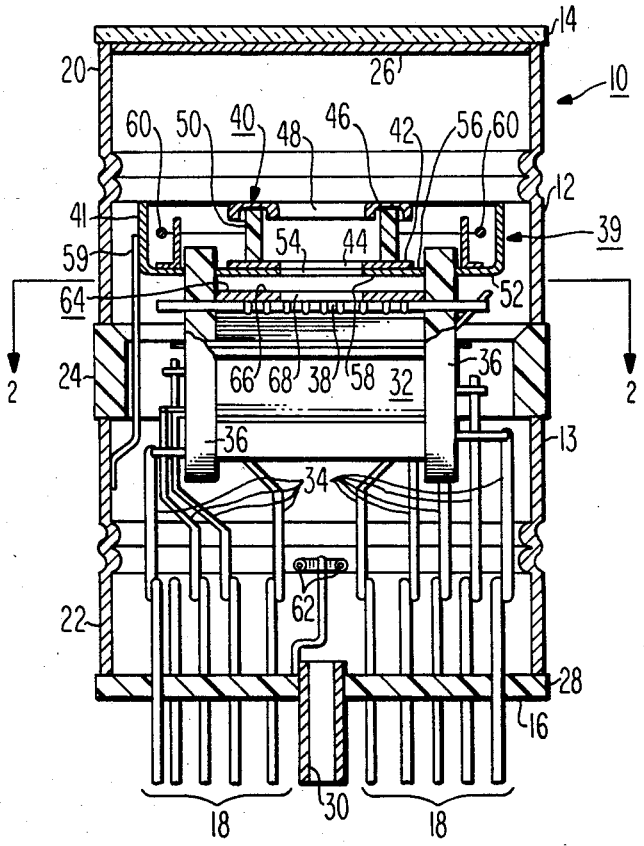
FIG. 1 is a partially broken-away sectional view of a photomultiplier tube embodying the present invention.
Figure 2:
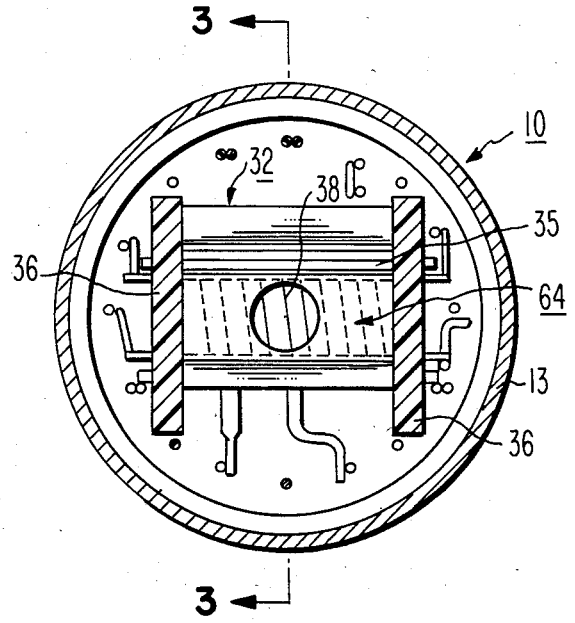
FIG. 2 is a sectional view taken along lines 2—2 of FIG. 1.
Figure 4:
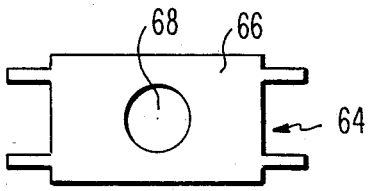
FIG. 4 is a plan view of the novel thermionic electron control plate of the present invention.

Referring to the drawings, there is shown in FIG. 1 a photomultiplier tube 10 comprising an evacuated envelope 12 having a generally cylindrical sidewall 13, a transparent faceplate 14 and a stem section 16 through which a plurality of stem leads 18 are sealed. The envelope 12 includes a cathode subassembly 20 and a stem subassembly 22. The cathode subassembly 20 is separated from the stem subassembly 22 by a ceramic member 22 brazed between the cathode and stem subassemblies. A photoemissive cathode 26 is formed on the interior surface of the faceplate 14. The cathode 26 is preferably an alkali-antimonide structure and provides photoelectrons in response to radiation incident thereon. The faceplate 14 is shown to be a plano-plano window, for example, of sapphire or other suitable materials, although, sapphire is preferred. The sapphire faceplate 14 provides a reasonable cost, nonreactive substrate on which to form the cathode 26. The stem 16 is a ceramic-metal structure comprising a ceramic base 28 and a metal tubulation 30. The metal tubulation 30 is preferably made of a copper alloy which may be cold-welded, subsequent to cathode formation to form a vacuum seal. The tubulation 30 is brazed to the ceramic plate 28 by a method well known in the art. The stem leads 18 extend through the ceramic plate 28 and are vacuum sealed thereto, e.g., by brazing.

Figure 3:
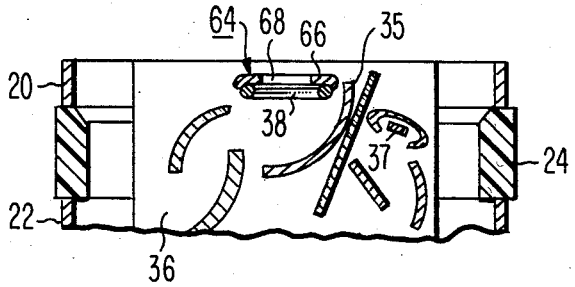
FIG. 3 is a sectional view of a fragment of the tube taken along lines 3—3 of FIG. 2.

An electron multiplier assembly, indicated generally as 32, is supported within the envelope 12 by a plurality of leads 32 (only some of which are shown). The leads 34 are attached at one end to the internally projecting stem leads 18. As shown in FIG. 3, the multiplier assembly 32 comprises a plurality of dynodes, including a primary dynode 35, supported between a pair of dynode support spacers 36, only one of which is shown in FIG. 3. The dynodes comprise secondary emissive electrodes for propagating and concatenating electron emission from the cathode 26 to an anode 37 enclosed within the last dynode. A field mesh 38 overlies the primary dynode 35 and is contiguous therewith. For high temperature operation, dynodes formed from a beryllium copper alloy and having a beryllium-oxide secondary emissive surface are preferred; although, nickel dynodes, having an alkali antimonide secondary emissive surface, may be used at lower operating temperatures.

With reference to FIG. 1, the dynode support spacers 36 are attached to a focusing assembly 39 disposed between the cathode 26 and the multiplier assembly 32. The focusing assembly 39 includes a primary focusing electrode subassembly 40 and a secondary focusing electrode 41. The primary focusing electrode subassembly 40 comprises a substantially flat conductive annular member 42, having a centrally disposed aperture 44, therethrough. Spaced from the annular member 42 is a U-cross-sectionally-shaped conductive annular top cap 46, having an aperture 48 formed therein. A tubular ceramic cylinder 50 is brazed between the flat member 42 and the top cap 46. The secondary focusing electrode 41 is preferably a cup-shaped conductive member, having a substantially flat base 52 with a centrally disposed aperture 54 formed therethrough. The flat base 52 has an interior, or first, surface 56 and an exterior, or second, surface 58. The flat conductive annular member 42 of the primary electrode subassembly 40 is affixed to the first surface 56 of the secondary focusing electrode 41 in such a manner that the apertures 44, 48 and 54 are mutually aligned to focus the photoelectrons from the cathode 26 onto the primary dynode 35 of the electron multiplier assembly 32. A strap 59 connects the secondary focusing electrode 41 to the sidewall 13 of the envelope 12. A connector (not shown) is provided to the top cap 46 to apply a focusing potential thereto.

At least one antimony evaporator source 60 is disposed within the tube 10 in order to form the cathode 26 on the faceplate 14. As shown in FIG. 1, two antimony sources 60 are used to provide a uniform antimony film. At least one, and preferably two, alkali generators 62 are provided to form the alkali-antimonide cathode 26 and to provide a low work-function alkali material for the surface of the dynodes in the electron multiplier 32. Photoemissive cathode formation and dynode sensitizing are well known in the art and need not be described in detail. Photoemissive materials and techniques relating thereto are described, for example, in "Photoemissive Materials", by A. H. Sommer, John Wiley and Sons, Inc., New York 1968, which is incorporated by reference herein. As herein described to this point, the tube 10 is identical to the RCA C83027 photomultiplier tube disclosed in U.S. Pat. No. 4,376,246 to Butterwick.

A novel thermionic electron control plate 64, shown in FIGS. 1 to 4, is attached, for example, by welding, to the surface of the field mesh 38. The control plate 64 has an electron impervious portion 66 with an aperture 68 formed therein, which is aligned with the apertures 44, 48 and 54 of the focusing assembly 39. The control plate 64 is made from a non-magnetic material, such as beryllium-copper or stainless steel and is typically about 0.25 mm (0.01 inches) thick. The plate aperture for the C83027 is typically about 4.57 mm (0.18 inches) in diameter. The plate 64 is insulatingly spaced from the second surface 58 of the secondary focusing electrode 41 of the focusing assembly 39 by the dynode support spacers 36.

The operation of the improved photomultiplier tube 10, described herein, may be understood by reference to FIG. 1. The cathode 26 and the secondary focusing electrode 41 of the focusing assembly 39 are operated at a common negative potential. The potentials applied to the dynodes of the electron multiplier assembly 32 are progressively more positive than the cathode potential, and the anode 37 (FIG. 3) is typically at ground potential. The top cap 46 of the focusing assembly 39 is operated at a potential positive with respect to the cathode 26 and the secondary focusing electrode 41. In the preferred operational mode, the top cap 46 is electrically connected to the first dynode potential. Alternatively, other potentials may be applied to the top cap over one of the stem leads 18 extending through the stem section 16 of the tube. An external voltage divider (not shown) is provided to establish the desired operating potentials for the tube elements. The operating potentials are directed into the tube by means of the stem leads 18.

During the operation of the tube, the thermionic electron control plate 64, attached to the field mesh 38, operates at first dynode potential. The electron impervious portion 66 of the plate 64 acts as a collector for thermionic electrons emanating from the second surface 58 of the secondary focusing electrode 41, which operates at cathode potential. The thermionic electrons are produced by the low work function alkali material which is deposited on the second surface 58 of electrode 41 during cathode formation and dynode sensitizing. The plate 64 intercepts the thermionic electrons, while permitting the photoelectrons from the cathode 26 to pass through the plate aperture 68 onto the primary dynode 35.

What is claimed is:

1. In an electron discharge device of the type including an evacuated envelope having therein a plurality of elements including a photoemissive cathode for providing photoelectrons in response to radiation incident thereon, electron multiplier means having a primary dynode spaced from said cathode, focus means disposed between said cathode and said multiplier means for focusing said photoelectrons, and means for applying operating potentials to said elements, the improvement comprising a thermionic electron control plate disposed between said focus means and said multiplier means for preventing thermionic electrons emanating from said focus means from impinging on said primary dynode while permitting the passage of said photoelectrons to said primary dynode, said control plate overlying said primary dynode and being contiguous therewith, said control plate and said primary dynode being electrically connected.

2. In a photomultiplier tube of the type comprising an evacuated envelope having a sidewall portion, a faceplate extending across one end of said sidewall portion and a stem section closing the other end of said sidewall portion, said envelope having therein a plurality of elements including a photoemissive cathode disposed on an interior surface of said faceplate for providing photoelectrons in response to radiation incident thereon;

an electron multiplier assembly comprising a plurality of dynodes including a primary dynode spaced from said cathode;

focus means disposed between said cathode and said electron multiplier assembly, said focus means having an aperture therethrough for focusing said photoelectrons, and means for applying operating potentials to said elements, the improvement comprising a thermionic electron control plate disposed between said focus means and said electron multiplier assembly, said control plate having an electron impervious portion for preventing thermionic electrons emanating from said focus means from impinging on said primary dynode and a plate aperture aligned with said aperture in said focus means to permit the passage of photoelectrons from said cathode to said primary dynode of said multiplier assembly said control plate being connected to said primary dynode and operating at the potential of said dynode.

3. The tube as in claim 2, wherein said thermionic electron control plate comprises a non-magnetic material.

4. In a photomultiplier tube of the type including an evacuated envelope having a generally cylindrical sidewall portion, a faceplate extending across one end of said sidewall portion and a stem section closing the other end of said sidewall portion;

a photoemissive cathode disposed on an interior surface of said faceplate for providing photoelectrons in response to radiation incident thereon;

an electron multiplier assembly having a primary dynode, a plurality of secondary dynodes and an anode spaced from said cathode, said primary dynode having a field mesh contiguous therewith;

a focusing assembly disposed between said cathode and said electron multiplier assembly, said focusing assembly including a primary focusing electrode subassembly and a secondary focusing electrode having a first and a second surface, said primary focusing electrode subassembly including an annular top cap insulatingly spaced from said first surface of said secondary focusing electrode, said secondary focusing electrode and said top cap having mutually aligned apertures therethrough for focusing said photoelectrons onto said primary dynode of said electron multiplier assembly, the improvement comprising a thermionic electron control plate insulatingly spaced from said second surface of said secondary focusing electrode and connected to said field mesh and to said primary dynode, said control plate having an electron impervious portion for preventing thermionic electrons emanating from said second surface of said secondary focusing electrode from impinging on said primary dynode and a plate aperture aligned with said mutually aligned apertures in said secondary focusing electrode and in said top cap for permitting the passage of photoelectrons from said cathode to said primary dynode.

5. The tube as in claim 4, wherein said thermionic electron control plate comprises a non-magnetic material.

* * * * *

UNITED STATES PATENT AND TRADEMARK OFFICE

CERTIFICATE OF CORRECTION

PATENT NO. : 4,588,922

DATED : May 13, 1986

INVENTOR(S) : Richard Dale Faulkner

It is certified that error appears in the above-identified patent and that said Letters Patent is hereby corrected as shown below:

Column 2, line 65

"32" should be --34--.

Signed and Sealed this

*Twenty-ninth* Day of *July 1986*

[SEAL]

*Attest:*

DONALD J. QUIGG

*Attesting Officer*

*Commissioner of Patents and Trademarks*